US006712537B2

(12) United States Patent
Hung

(10) Patent No.: US 6,712,537 B2
(45) Date of Patent: Mar. 30, 2004

(54) SOLVENT CONTAINER WITH DUAL PURPOSE DISPENSER

(76) Inventor: Chih-Min Hung, No. 168, Chung-Jen Road, Tsow-Inn District, Kaohsiung City (TW)

( * ) Notice: Subject to any disclaimer, the term of this patent is extended or adjusted under 35 U.S.C. 154(b) by 0 days.

(21) Appl. No.: 10/066,611

(22) Filed: Feb. 6, 2002

(65) Prior Publication Data

US 2003/0147684 A1 Aug. 7, 2003

(51) Int. Cl.[7] ..... A45D 29/00

(52) U.S. Cl. ..... 401/26; 401/16; 401/36; 401/129

(58) Field of Search ..... 401/26, 129, 16, 401/36; 132/73

(56) References Cited

U.S. PATENT DOCUMENTS 4,063,829 A * 12/1977 La Mura ..... 401/101
5,746,529 A * 5/1998 Peters et al. ..... 401/18
5,897,262 A * 4/1999 Bratby-Carey ..... 401/18
5,913,630 A * 6/1999 Kelders et al. ..... 401/126
6,004,055 A * 12/1999 Cheng ..... 401/126
6,059,474 A * 5/2000 Huang ..... 401/129
6,065,477 A * 5/2000 Doo ..... 132/73
6,158,443 A * 12/2000 Leman et al. ..... 132/120

* cited by examiner

*Primary Examiner*—Henry Bennett
*Assistant Examiner*—Azy Kokabi
(74) *Attorney, Agent, or Firm*—Troxell Law Office PLLC

(57) ABSTRACT

A solvent container with dual purpose dispenser that includes a container body, a pencil head holder, a brush rod and a top cover combined together. The brush rod has a hollow brush rod head, which has an outer circumferential edge formed with a projecting rim. The pencil head holder has a hollow cavity with an engage groove for receiving the projecting rim of the hollow brush rod head, thus, the brush rod and the pencil head holder are engaged with each other directly. The pencil head holder has an upper solvent outlet tube. The pencil head holder and solvent outlet tube thereby preventing the solvent outlet tube from moving biasly to ensure safety during use.

1 Claim, 9 Drawing Sheets

SOLVENT CONTAINER WITH DUAL PURPOSE DISPENSER

BACKGROUND OF THE INVENTION

This invention relates to a multi-functional dispenser, particularly to one convenient to be assembled and disassembled, and possible to economize producing time and cost.

Two conventional multi-functional dispensers respectively disclosed in the U.S. Pat. No. 6,065,477shown in FIG. 1 and U.S. Pat. No. 6,059,474 shown in FIG. 2, titled "MULTI-FUNCTIONAL FINGER ENAMEL DISPENSER", are made with the same technique and have the same feature.

As shown in FIG. 2, the multi-functional finger enamel dispenser includes a resilient hollow tube 10 and a brush pencil 20. The brush pencil 20 is composed of a brush pencil body 21, a brush rod 22 and a pencil cap 23. The brush pencil body 21 has opposite ends communicating with each other and is provided at the bottom with an open hole 211 with an inner threaded portion 212 to be threadably fitted with an outer threaded portion 13 of the hollow tube 10. Further, the brush pencil body 21 has its inner intermediate portion shrunken into a shoulder 214, and is disposed inside with a conical pencil head 24 having a projecting ring 241 on top resting on the shoulder 214, with the pencil tube 242 of the pencil head 24 extending out of the brush pencil body 21 through the open hole 213 on top.

In addition, a connect member with female threads 215 is provided between the inner threaded portion 212 and the shoulder 214 of the brush pencil body 21, and a connect base 221 with male threads 227 is fitted protruding on top of the brush rod 22. The outer diameter of the upper connect portion 222 of the connect base 221 is equal to the inner diameter of the opening 243 of the pencil head 24, with the connect base 221 fixed with the connect member of the brush pencil body 21. The connect base 221 further has a stuffing ring 223 shrunken at the bottom and having an outer diameter equal to the inner diameter of the opening 12 of the resilient hollow tube 10. Then, the brush rod 22 has a plurality of solvent guiding holes 224 bored along the rod wall at a proper location under its connect base 221, with the solvent guiding holes opened through upward to make the top of the brush rod 22 formed into an open hole 225 and having a brush hair 226 fixed on the bottom.

However, the conventional finger enamel dispenser described above has the following disadvantages.

1. High producing time and cost: The conventional device is made of at least five essential components including a brush pencil body, a pencil head, a pencil tube, a connect base and a brush rod, being complicated to combine the components with one another.

2. Not easy to be assembled and disassembled: The combination among its components is complicated, so it is not easy to be disassembled for cleaning in case the pencil head, the pencil tube or the connect base should be blocked, and it is difficult to be assembled after cleaning.

3. Unsafe in using: The pencil head tightly pushed by the brush rod is fixed inside the brush pencil body, and the pencil tube at the end portion of the pencil head is in a fixed condition, therefore the pencil tube is liable to damage the surface of a finger nail in case of an excessive force in paining it.

SUMMARY OF THE INVENTION

The objective of the invention is to offer a multi-functional dispenser easy to be assembled and disassembled and possible to economize producing time and cost.

The multi-functional dispenser of the invention includes a container body, a pencil head bolder, a brush rod and a top cover. The feature is that the hollow brush rod head of the brush rod has its outer circumferential edge formed into a projecting rim, and the hollow cavity of the pencil head holder has a bottom connect opening formed with an engage groove so as to let the brush rod and the pencil head holder engaging with each other directly. Besides, the pencil head holder and its top solvent outlet tube are formed integral, thus, preventing the solvent outlet tube from moving biasly to ensure safety in using, and lowering producing time and cost.

BRIEF DESCRIPTION OF DRAWINGS

This invention will be better understood by referring to the accompanying drawings, wherein.

DETAILED DESCRIPTION OF THE PREFERRED EMBODIMENT

Figure 1A:
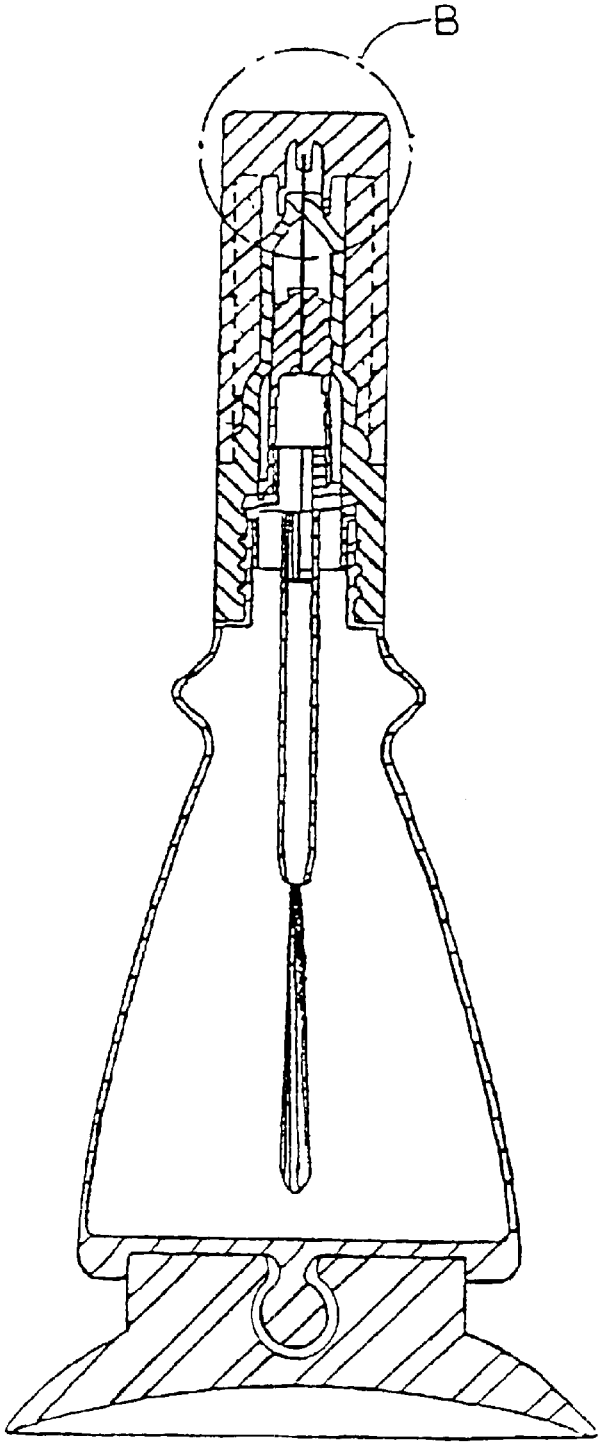
Fig.1A Prior Art.
FIG. 1 is a cross-sectional view of a conventional finger enamel dispenser disclosed in an U.S. Pat. No. 6,065,477.
Figure 1B:
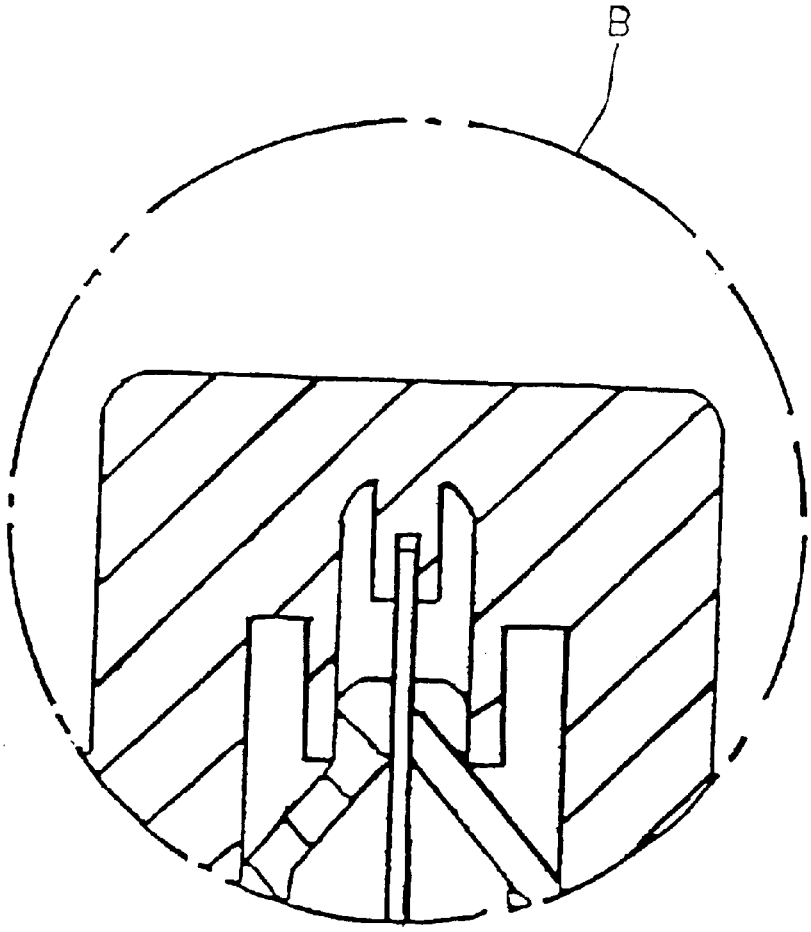
Fig.1B Prior Art.
Figure 2:
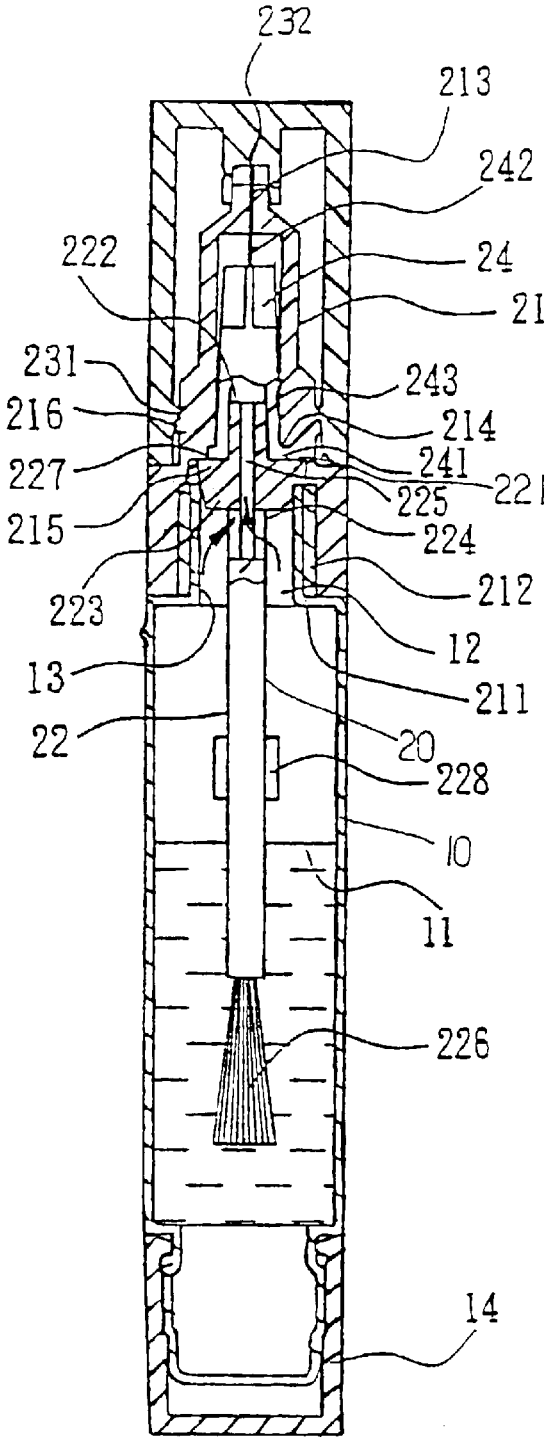
Fig.2 Prior Art.
FIG. 2 is a cross-sectional view of a conventional finger enamel dispenser disclosed in an U.S. Pat. No. 6,059,474.
Figure 3:
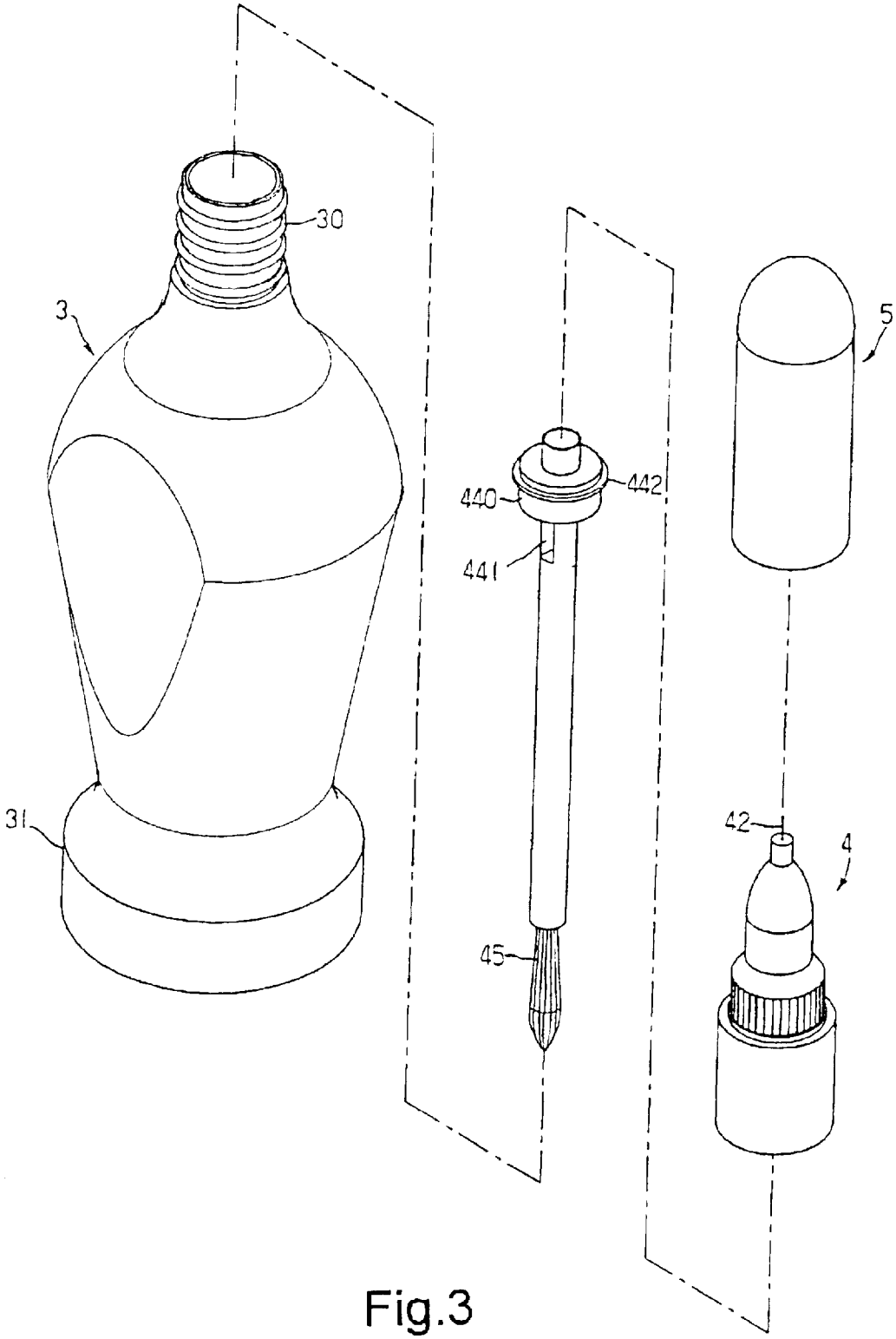
FIG. 3 is an exploded perspective view of a multi-functional dispenser in the present invention.
Figure 4:
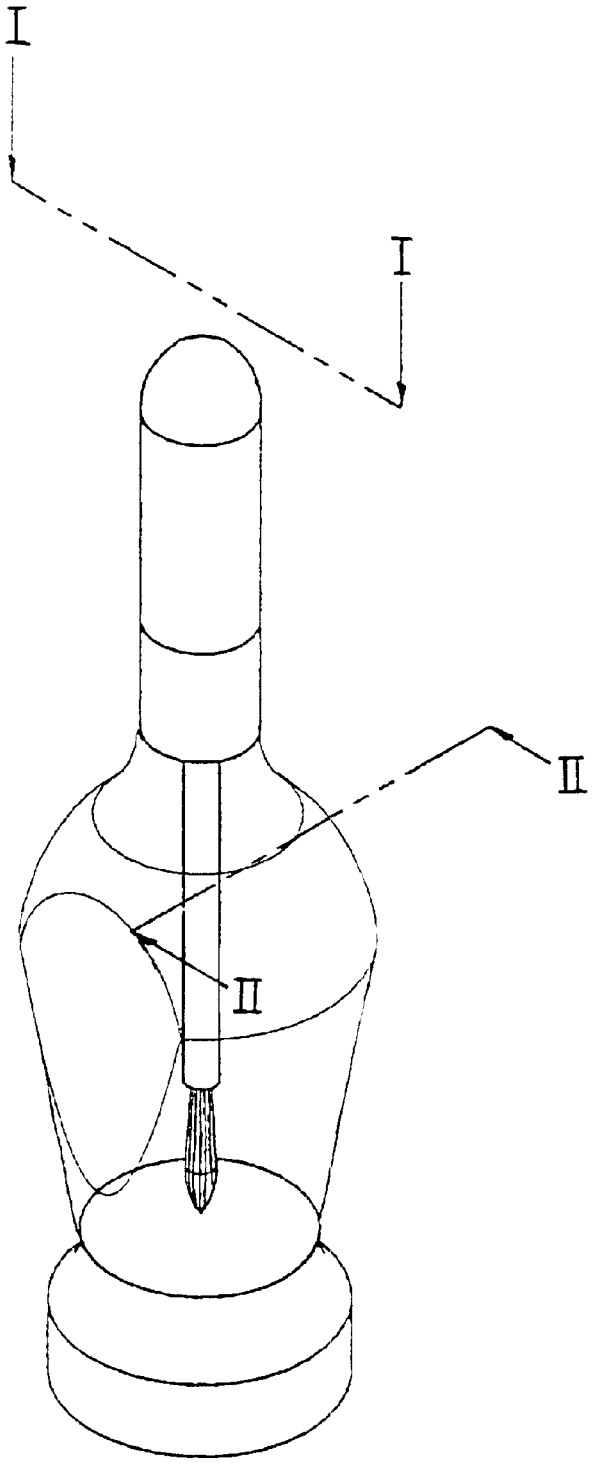
FIG. 4 is a perspective view of the multi-functional dispenser i n the present invention.

A preferred embodiment of a multi-functional dispenser in the present invention includes a container body 3, a pencil head holder 4, a brush rod 44 and a top cover 5 as main component combined together.

The container body 3 is an interior hollow container for filling in a solvent such as finger enamel or correcting agent. The container body 3 is provided with a bottom base 31 at the bottom and male threads 30 around the outer circumferential edge of a mouth on top for the pencil head holder 4 to be threadably fitted therein. Further, the container body 3 is made of resilient soft material to be easily pressed with fingers.

The pencil head holder 4 is formed with female threads 40 around the bottom inner edge to engage threadably with the male threads 30 on top of the container body 3. The pencil head holder 4 is formed inside with a hollow cavity 41 having its top end shrunken and provided with a solvent outlet tube 42 protruding out of the pencil head holder 4, and a connect opening 43 formed at the bottom for receiving the brush rod 44.

The brush rod 44 is provided on top with a hollow brush rod head 440 communicating with the hollow cavity 41 of the pencil head holder 4. Then, one or more solvent guiding holes 441 are bored on the brush rod 44 adjacent to the hollow brush rod head 440 to let the solvent get into the hollow brush rod head 440 and filled up the hollow cavity 41 of the pencil head holder 4 through these solvent guiding holes 441. Thus, a proper amount of solvent can be squeezed out through the solvent outlet tube 42 when the container body 3 is pressed. Besides, a brush hair 45 is fixed at the bottom of the brush rod 44 for smearing.

Figure 5A:
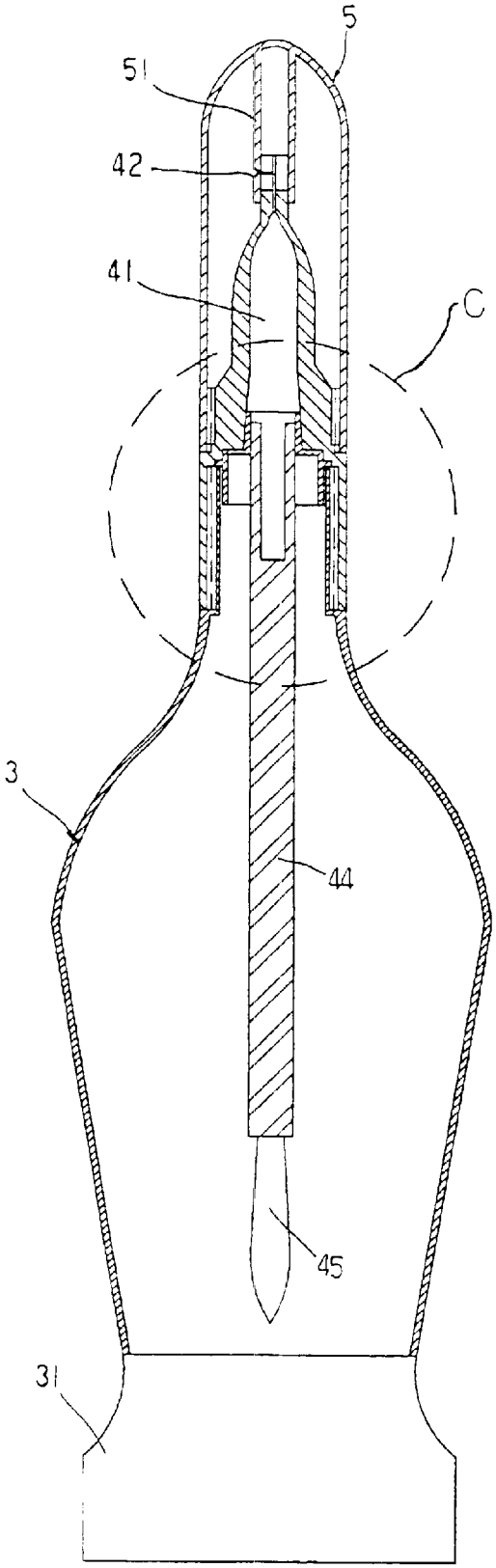
FIG. 5 is a cross-sectional view of the line A—A in FIG. 4.
Figure 5B:
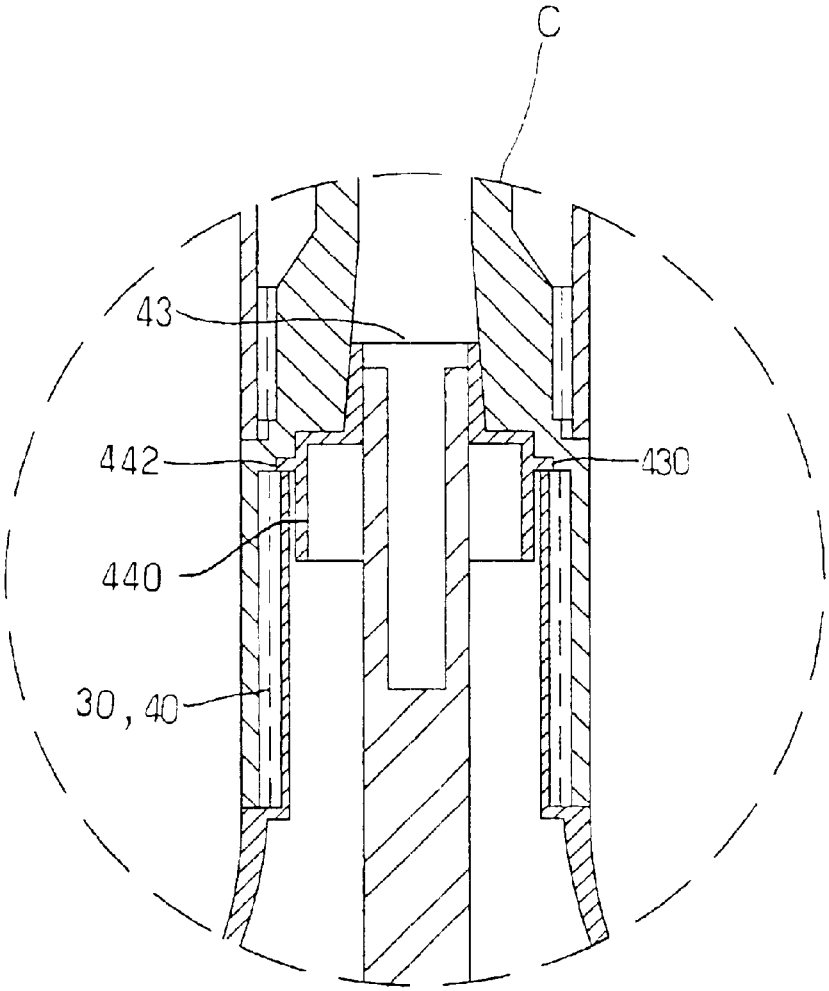

The top cover 5 for covering up the upper portion of the pencil head holder 4, as shown in FIG. 5, is formed with a stuffing member 51 on the inner top to let the solvent outlet tube 42 of the pencil head holder 4 completely sealed in this stuffing member 51 to prevent the solvent from seeping out when the top cover 5 is covered around the pencil head holder 4.

The feature of the invention is that the hollow brush rod head 440 of the brush rod 44 has its out circumferential edge formed into a projecting rim 442, and the hollow cavity 41 of the pencil head holder 4 has its bottom connect opening 43 bored with an engage groove 430 to correspond to the projecting rim 442 so as to permit the brush rod 44 and the pencil head holder 4 to engage with each other directly.

Specifically, the brush rod 44 and the pencil head holder 4 are combined together by the engagement of the projecting rim 442 and the engage groove 430 so the brush rod 44 can easily be disengaged from the connect opening 43 of the brush head holder 4 for cleaning in case the solvent outlet tube 42 of the pencil head holder 4 or the hollow brush rod head 440 of the brush rod 44 is blocked. Besides, the projecting rim 442 and the engage groove 430 are impossible to be damaged in using, because they are made of flexible material. After cleaning, simply press the brush rod 44 to be fitted in the connect opening 43 of the pencil head holder 4 to let the projecting rim 442 of the hollow brush rod head 440 meshed with the engage groove 430 of the connect opening 43.

Figure 6:
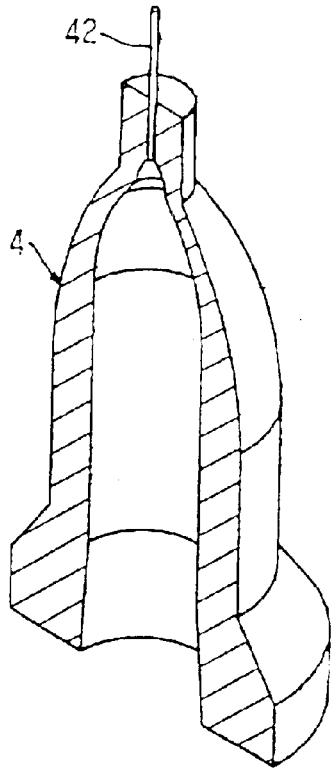
FIG. 6 is a partial perspective view of a pencil head holder in the present invention.

The solvent outlet tube 42 and the pencil head holder 4 are made integral, so the solvent outlet tube 42 cannot slide or move biasly, as shown in FIG. 6. If a user carries on painting with an excessive force (over 1.5 kg), the solvent outlet tube 42 will sink in the pencil head holder 4 to prevent damage to the surface of a finger nail, ensuring safety in painting finger nails, lowering producing time and cost due to comparatively few components and simple producing processes, and heightening competitive force of products.

Figure 7:
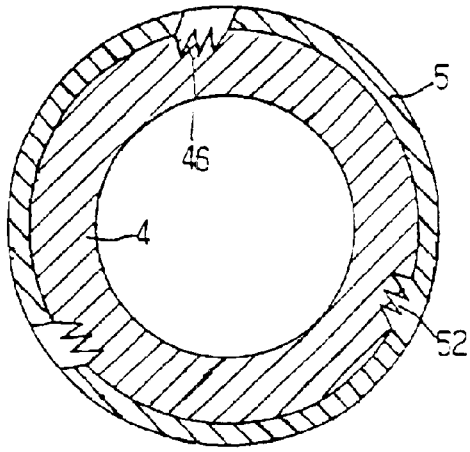
FIG. 7 is a cross-sectional view of the line B—B in FIG. 4.

Furthermore, as shown in FIG. 7, the intermediate circumferential portion of the pencil head holder 4 for engaging the top cover 5 is formed with toothed rings 46, and the top cover 5 has its inner circumferential wall formed with one or more engage teeth 52 matching with the toothed rings 46 and respectively having one or more teeth.

When the top cover 5 is mounted around the pencil head holder 4, the engage teeth 52 of the top cover 5 can easily mesh with the toothed rings 46 of the pencil head holder 4. Thus, when the top cover 5 is fitted with and turned around the pencil head holder 4, the pencil head holder 4 can synchronously be screwed in or out along the male threads 30 of the container body 3 for facilitating using the brush hair 45.

Figure 8:
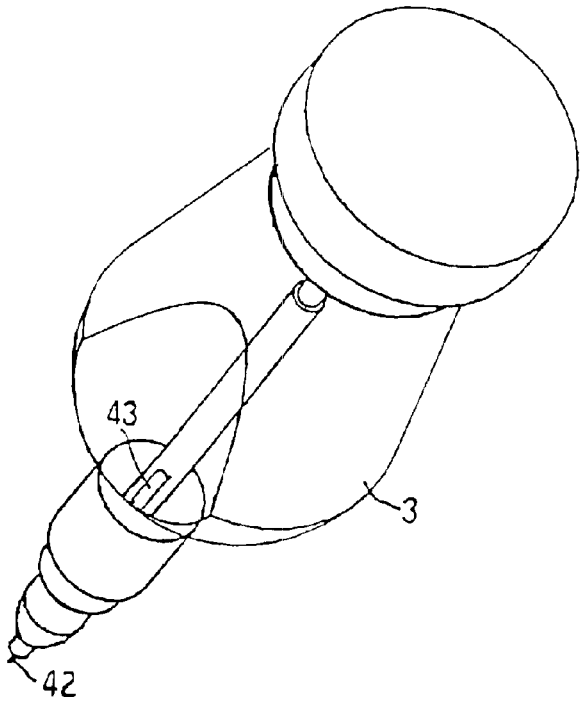
FIG. 8 is a perspective view of an embodiment of the multi-functional dispenser in a using condition in the present invention.
Figure 9:
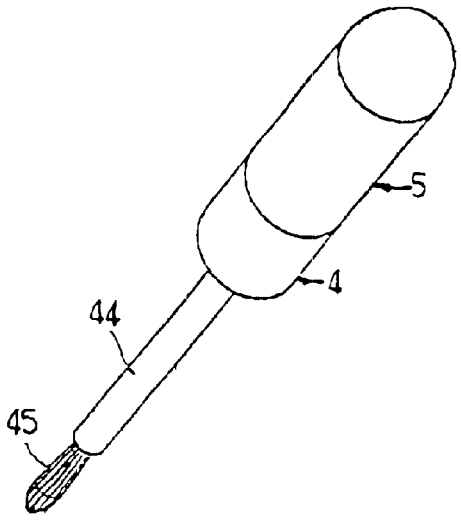
FIG. 9 is a perspective view of another embodiment of the multi-functional dispenser in a using condition in the present invention.

In using, as shown in FIG. 8, when the container body 3 is filled up with finger enamel to be used for painting, just pull up the top cover 5 and press the container body 3 with fingers to let the solvent flow into the hollow cavity 41 of the pencil head holder 4 through the solvent guiding hole 43 and then get it out for use through the solvent outlet tube 42. When the brush hair 45 is to be used for smearing the surface of finger nails, only let the top cover 5 fitted around the pencil head holder 4 and then directly turned around to let its engage teeth 52 meshed with the tooth rings 46 of the pencil head holder 4, and thus the pencil head holder 4 is synchronously turned around and disengaged from the container body 3 to let the brush hair 45 ready for use.

As can be noted from the above description, the invention has the following advantages.

1. Having high practicability. The brush rod and the pencil head holder are combined together by meshing the projecting rim with the engage groove so the brush rod is easy to be disengaged from the pencil head holder for cleaning. Besides, the projecting rim of the brush rod and the engage groove of the pencil head holder are made of fixable material, so they will not be damaged in using. After cleaning, the brush rod is directly pressed and inserted in the connect opening of the pencil head holder to let the projecting rim fitted with the engage groove, thus, facilitating assembling and disassembling.

2. Economizing producing cost. The solvent outlet tube and the pencil head holder are formed integral, not only preventing the solvent outlet tube from sliding or moving biasly to ensure safety in using, but also greatly lowering producing time and cost due to comparatively few components and simple producing and assembling processes, and heightening competitive force of products.

3. Having extensive adaptability: The container body can be filled with finger enamel solvent for painting finger nails or filled with correcting agent for correcting words.

While the preferred embodiment of the invention has been described above, it will be recognized and understood that various modifications may be made therein and the appended claims are intended to cover all such modifications that may fall within the spirit and scope of the invention.

I claim:

1. A solvent container with dual purpose dispenser comprising:

a) a container body having a hollow interior, a base, and male threads formed on an outer circumference on an upper portion thereof;

b) a pencil head holder having a top, a bottom and a hollow interior, female threads are formed in the hollow interior near the bottom and threadably engaged with the male threads of the container body, the hollow interior narrows at the top and receives a solvent outlet tube that extends out of the pencil head holder, a connect opening with an engage groove is formed on the hollow interior of the pencil head holder adjacent to the female threads;

c) a removable brush rod having a hollow brush rod head on a first end, a plurality of solvent guide holes bored on an outer circumference adjacent to the hollow brush rod head, and brush hair on a second end, the hollow brush rod head has a projecting rim around a circumferential edge, the hollow brush rod head being inserted into the hollow cavity of the pencil head holder and frictionally secured by the connection between the projecting rim of the hollow brush rod and the engage groove of the connect opening of the pencil head holder;

d) at top cover having a sealing device to seal the solvent outlet tube and a connecting device for slidably connecting the top cover to the pencil head holder, the connecting device prevents the top cover from turning easily relative to the pencil head holder, wherein the solvent outlet tube and the pencil head holder are integrally made; and, wherein the connecting device includes an intermediate circumference portion of the pencil head holder with toothed rings and the top cover has engaging teeth on an inner edge wall that match and engage the toothed rings on the pencil head holder.

* * * * *